US010959908B2

(12) United States Patent
Lee et al.

(10) Patent No.: US 10,959,908 B2
(45) Date of Patent: Mar. 30, 2021

(54) VERSATILE AND ERGONOMIC PERCUSSION MASSAGE APPLIANCE

(71) Applicant: Pado, Inc., Valencia, CA (US)

(72) Inventors: Steven Lee, Valencia, CA (US); Alejandro Garfio, Mission Viejo, CA (US); Travis Frye, Burbank, CA (US)

(73) Assignee: Pado, Inc., Valencia, CA (US)

( * ) Notice: Subject to any disclaimer, the term of this patent is extended or adjusted under 35 U.S.C. 154(b) by 183 days.

(21) Appl. No.: 16/168,100

(22) Filed: Oct. 23, 2018

(65) Prior Publication Data

US 2020/0085675 A1 Mar. 19, 2020

Related U.S. Application Data

(63) Continuation-in-part of application No. 29/663,757, filed on Sep. 18, 2018, now Pat. No. Des. 847,364.

(51) Int. Cl.

| | |
|---|---|
| ***A61H 23/00*** | (2006.01) |
| ***A61H 23/02*** | (2006.01) |
| ***A61H 15/00*** | (2006.01) |

(52) U.S. Cl.

CPC ..... *A61H 15/0085* (2013.01); *A61H 23/006* (2013.01); *A61H 23/02* (2013.01); *A61H 2201/0192* (2013.01)

(58) Field of Classification Search

CPC .... A61H 7/003; A61H 23/00; A61H 15/0085; A61H 2201/0153; B25B 23/16; B25G 1/102; B25G 3/38

USPC ..... 81/177.1–177.85

See application file for complete search history.

(56) References Cited

U.S. PATENT DOCUMENTS

| | | | | |
|---|---|---|---|---|
| 1,545,027 A * | 7/1925 | Ashlock | ..... | A61H 23/0254 601/101 |
| 1,657,765 A * | 1/1928 | Pasque | ..... | A61H 23/0254 601/108 |
| 1,660,821 A * | 2/1928 | Sweetland | ..... | A61H 23/0254 601/101 |
| 2,078,159 A * | 4/1937 | Redding | ..... | A61H 23/04 606/238 |

(Continued)

OTHER PUBLICATIONS

Timtam Power Massager V1.5, retrieved from https://timtam.tech/products/timtam-power-massager-v1-5 approximately Aug. 31, 2018.

(Continued)

*Primary Examiner* — Justine R Yu
*Assistant Examiner* — Christopher E Miller
(74) *Attorney, Agent, or Firm* — Sheppard, Mullin, Richter & Hampton LLP

(57) ABSTRACT

A percussive massage appliance has a general Y-shape, with first and second handle portions being suitable for being held by first and second hands, respectively, of a user, with the percussive massage head reciprocating along an axis that lies in a major arc defined by the two handle portions. One use for the device is so that a user can grip the device with both hands while delivering a percussive massage to his own lower back muscles. The device has a rotation mechanism such that the user can rotate the reciprocation axis through an arc of about 120 degrees relative to the handles, and an extension handle mates with one of the handle portions, providing great versatility to the user.

24 Claims, 14 Drawing Sheets

(56) References Cited

U.S. PATENT DOCUMENTS 3,169,521 A * 2/1965 McCaw ..... A61H 7/005 601/87
3,494,353 A * 2/1970 Marich ..... A61H 23/0254 601/73
D222,570 S 11/1971 Rowley et al.
3,993,052 A * 11/1976 Miyahara ..... A61H 7/005 601/87
4,669,452 A * 6/1987 Osawa ..... A61H 23/0263 601/46
D301,617 S 6/1989 Yonesawa et al.
5,117,815 A * 6/1992 Gentry ..... A61H 23/0263 601/138
5,193,528 A * 3/1993 Iwamoto ..... A61H 23/0263 601/72
D373,197 S 8/1996 Schepper
D388,175 S 12/1997 Lie
D407,498 S 3/1999 Cooper
D456,909 S 5/2002 Szabo
D484,248 S 12/2003 O'Brien
D530,020 S 10/2006 Cooper
7,125,390 B2 * 10/2006 Ferber ..... A61H 7/001 601/101
7,435,232 B2 * 10/2008 Liebschner ..... A61B 5/4504 128/920
D627,897 S 11/2010 Yde et al.
D649,657 S 11/2011 Petersen et al.
D657,065 S 4/2012 Matsushita
D666,734 S 9/2012 Takashima
8,372,111 B2 * 2/2013 Reyna ..... A61H 7/001 601/129
D698,935 S 2/2014 Larson
D708,755 S 7/2014 Kim
9,532,918 B1 * 1/2017 Louis ..... A61H 7/003
D818,599 S 5/2018 Lee
D820,466 S 6/2018 Matsushita
D826,418 S 8/2018 Lad
10,327,981 B1 * 6/2019 Ayotte ..... A61H 15/0092
2003/0009116 A1 * 1/2003 Luettgen ..... A61H 19/50 601/46
2004/0254507 A1 12/2004 Off
2006/0155220 A1 7/2006 Oslay
2006/0282025 A1 * 12/2006 McDonald ..... A61H 23/0263 601/46
2007/0270727 A1 * 11/2007 Khorassani Zadeh ..... A61H 1/008 601/120
2009/0306560 A1 * 12/2009 Lund ..... A61H 7/003 601/135
2011/0224588 A1 * 9/2011 Grippo ..... A61H 7/003 601/135
2012/0067164 A1 * 3/2012 Su ..... B25G 3/38 74/575
2013/0261516 A1 10/2013 Cilea et al.
2014/0358045 A1 * 12/2014 Toto ..... A61F 7/08 601/18
2015/0005682 A1 * 1/2015 Danby et al. ..... A61H 23/0254 601/101
2015/0150758 A1 * 6/2015 Turnbow-Faraci .... A47K 7/022 601/18
2016/0367425 A1 * 12/2016 Wersland ..... A61H 1/008
2017/0042754 A1 * 2/2017 Fowers ..... A61H 7/001
2017/0304145 A1 * 10/2017 Pepe ..... A61H 23/006
2017/0326021 A1 11/2017 Matsushita
2018/0200141 A1 * 7/2018 Wersland ..... A61H 23/006
2019/0175434 A1 * 6/2019 Zhang ..... A61H 23/06

OTHER PUBLICATIONS

Back Muscle Pain Massger Wooden Stick T-Shaped Cross Wood Body Therapy Spa, retrieved from eBay.com approximately Aug. 31, 2018.
Wahl Deep-Tissue Percussion Therapy Massager, retrieved from https://wahlusa.com/products/deep-tissue-4290-300 approximately Aug. 31, 2018.
Zyllion ZMA-16 Handheld Therapeutic Percussion Massager With Heat, retrieved as an archived version from Amazon.com dated Apr. 10, 2016.
Point Relief Manual Massager, retrieved from https://www.fab-ent.com/massage/manual-massagers/point-relief-manual-massager/ approximately Aug. 3, 2018.
Y Shape Solar Energy Beauty Bar/Body Massage Roller, retrieved from http://worjaku.com/product/y-shape-solar-energy-beauty-bar-body-massage-roller/ approximately Aug. 3, 2018.

* cited by examiner

VERSATILE AND ERGONOMIC PERCUSSION MASSAGE APPLIANCE

CROSS-REFERENCE TO RELATED APPLICATIONS

This application is a continuation-in-part of U.S. patent application Ser. No. 29/663,757 filed Sep. 18, 2018, which is fully incorporated as if set forth herein in its entirety.

BACKGROUND OF THE INVENTION

1. Field of the Invention

This invention relates to the field of electric massage appliances. More particularly, this invention relates to the field of a versatile and ergonomic percussion massage appliance.

2. Description of Related Art

Electric massage appliances, which will be henceforth referred to simply as "massagers" for ease of discussion, provide both pleasure as well as relief from aching muscles after vigorous sporting activities such as competitive sports or strenuous workouts. The benefits of massage therapy for reducing Delayed Onset Muscle Soreness (DOMS) has been extensively documented in the medical literature since the early 1900's. Massagers can be of the vibration variety, percussion variety, and others. Numerous vibration massagers and percussion massagers in a wide variety of configurations have been designed and sold.

Percussion massagers work by driving a massage head in reciprocating linear motion so that it repeatedly impacts against the muscle or other tissue being massaged. U.S. Patent Publication 2013/0261516 by Cilea for example discloses a battery-operated percussive massager having variable frequency and variable power, and interchangeable massage heads. Cilea's device looks much like a jigsaw such as is typically used in construction work, but modified slightly to provide a percussive massage head at the end of a reciprocating shaft instead of a saw blade.

One design goal for massagers is that the device be ergonomic, i.e., easy to use by either a solo user or by a therapist using the device on a subject patient, without requiring the user or therapist to twist his body or limbs into uncomfortable positions in order to receive the desired massage at the user's desired target location, or to otherwise hold the device in a way that becomes uncomfortable or fatiguing after too short a period. Another design goal, particularly for percussive massagers, is that the device be easily usable to press against any one of numerous potential target locations on a user's body with a large variation in pressures ranging from slight pressure to very heavy pressure as the user desires, again without undue stress or fatigue on the person applying the device.

SUMMARY OF THE INVENTION

The present invention is of a percussive electric massage appliance, or simply "massager," that is both ergonomic and versatile. The device allows for a wide range of uses on various target locations on the human body with various application pressures, such that the device can effectively reach locations on the body that otherwise could not be effectively reached with prior massagers, especially for a solo user applying the device to his own body. The device also allows for less fatigue while using the device, whether the user is a solo user or a therapist, as compared to various prior massagers.

According to an illustrative embodiment, a percussive electric massage appliance has a body that includes first and second handle portions extending from a central portion along first and second axes, respectively. The first and second handle portions define an obtuse angle between them, i.e., an angle of more than 90 degrees but less than 180 degrees, and preferably about 120 degrees. A reciprocating output shaft has a percussive massage head such as a ball attached to it for delivering the percussive massage to the subject. The reciprocating output shaft nominally subtends the major arc defined by the two handle portions, thus defining a generally Y-shaped device with the handle portions forming the arms of the "Y" and the output shaft forming the base of the "Y." The reciprocating motion of the output shaft defines a reciprocation axis. A rotation mechanism or "hinge" in its broad sense allows the rotation axis to be rotated about a wide angle, preferably through an angle of approximately 120 degrees, relative to the two handle portions. A rotation lock allows the device to be locked at the desired angle. One or more of the handle portions releasably mates with a handle extension, such that the extension can be added to the device or removed from the device with ease.

By allowing the angle of the output shaft to be rotated through a large angle of approximately 120 degrees, and with a removable extension handle, a user can easily and without undue contortion apply the device to many areas on his body including his back and thus give himself a percussive massage. When the user is using the device on his own lower back, the two handle portions are aligned at natural angles for the user to hold his two hands behind his back, grip the two handle portions with his two hands, and pull the massage head against his own back to deliver a soothing percussive massage to his own lower back muscles.

By allowing great versatility of application without undue contortion or strain, the device defines a highly ergonomic and versatile percussive massager. The device also provides a versatile and ergonomic device that can be used by a massage therapist to give a percussive massage to the subject.

In one aspect therefore, the invention is of a percussive electric massage appliance having a body, the body having a central portion and first and second handle portions that are each suitable for a human to grip using the operator's first and second hands, respectively. The handle portions extend from the central portion such that they form a minor angle of between 75° and 180°, and preferably about 120°, between them. An electric drive motor assembly is located at least partially in the body. The electric drive motor assembly includes an electric drive motor that produces a rotational output, and gearing that translates the rotational output of the motor to reciprocating output at an output shaft located within the major arc between the handle portions, and with a massage head such as a massage ball being mounted at the end of the output shaft. Preferably the massage head can be easily changed. The device may come with a number of different massage heads. The two handle portions may be of slightly different sizes as measured at their respective circumferences to allow users having different sized hands to primarily use the handle portion that best matches their hand sizes.

A rotation mechanism or hinge allows the output shaft to rotate relative to the body including the two handle portions, such that the output shaft can be rotated to any desired angle relative to the handle portions, including in-line with the first handle portion, in-line with the second handle portion, midway between the handle portions, or positions therebetween. The rotation mechanism allows the output shaft to be rotated through an angle of more than 90° and preferably 120° or even more. A locking mechanism locks the output shaft in the desired rotational position.

In the illustrative embodiment the motor is located within one handle portion and the battery, which may be rechargeable, is located in the other handle portion, so that the massager is evenly weight balanced.

Exemplary embodiments of the invention will be further described below with reference to the drawings, in which like numbers refer to like parts. The drawing figures might not be to scale, and certain components may be shown in generalized or schematic form and identified by commercial designations in the interest of clarity and conciseness.

DETAILED DESCRIPTION OF THE PREFERRED EMBODIMENTS

Figure 1:
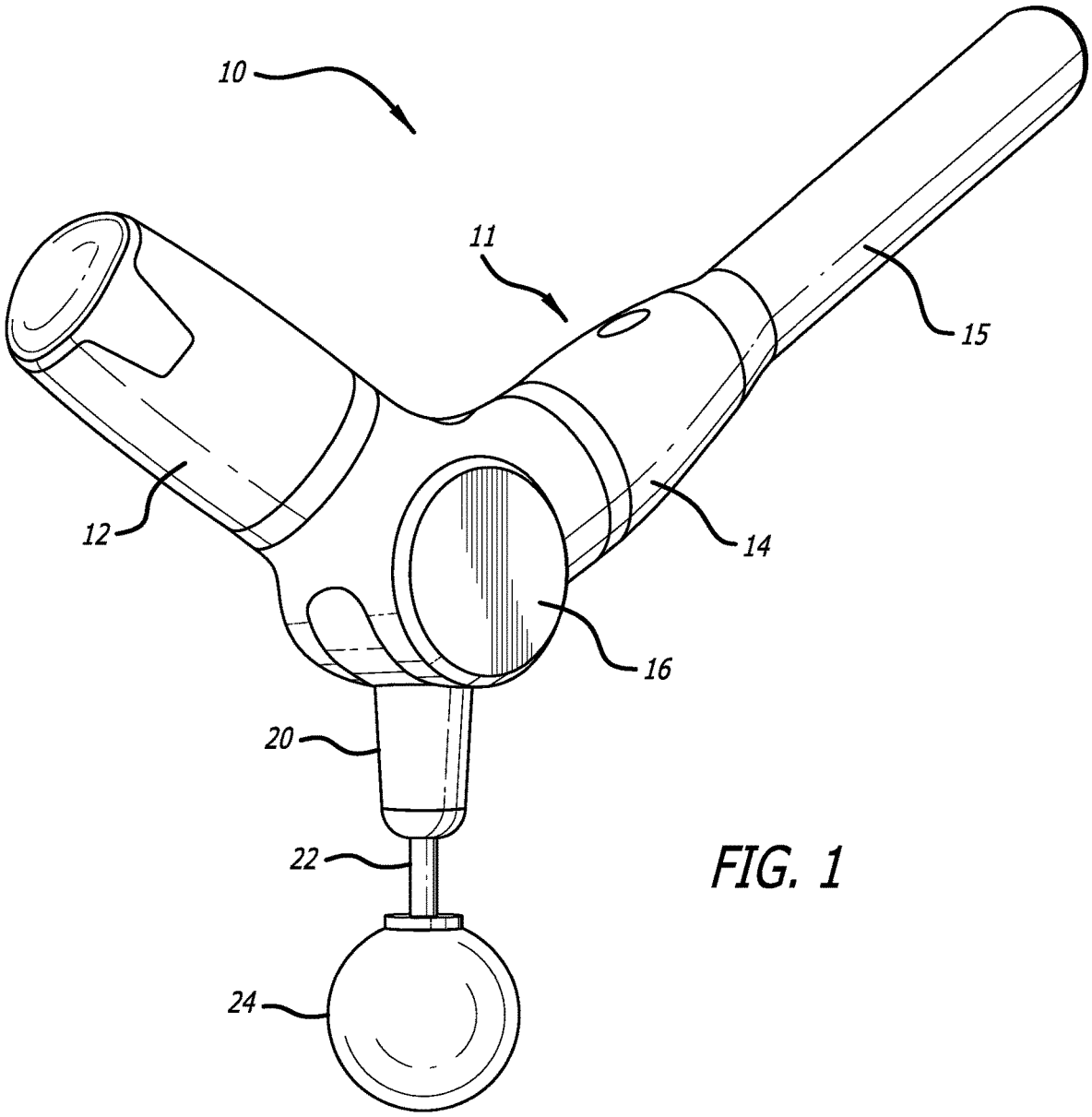
FIG. 1 is a perspective view of a percussive electric massage appliance according to an exemplary embodiment of the present invention, with the extension handle attached.

FIG. 1 is a perspective view of a percussive electric massage appliance or simply "massager" 10 according to an exemplary embodiment, with an extension handle 15 attached. Massager 10 includes a body 11 having a first handle portion 12 adapted and suitable for being gripped by a first hand of a user, a second handle portion 14 adapted and suitable for being gripped by a second hand of the user, and a central portion 16. Extension handle 15 releasably attaches to second handle portion 14. At the output end of massager 10 a massage head 24 such as the massage ball shown is affixed to the distal end of a reciprocating output shaft 22. Output shaft 22 is guided within guide tube 20.

Figure 2:
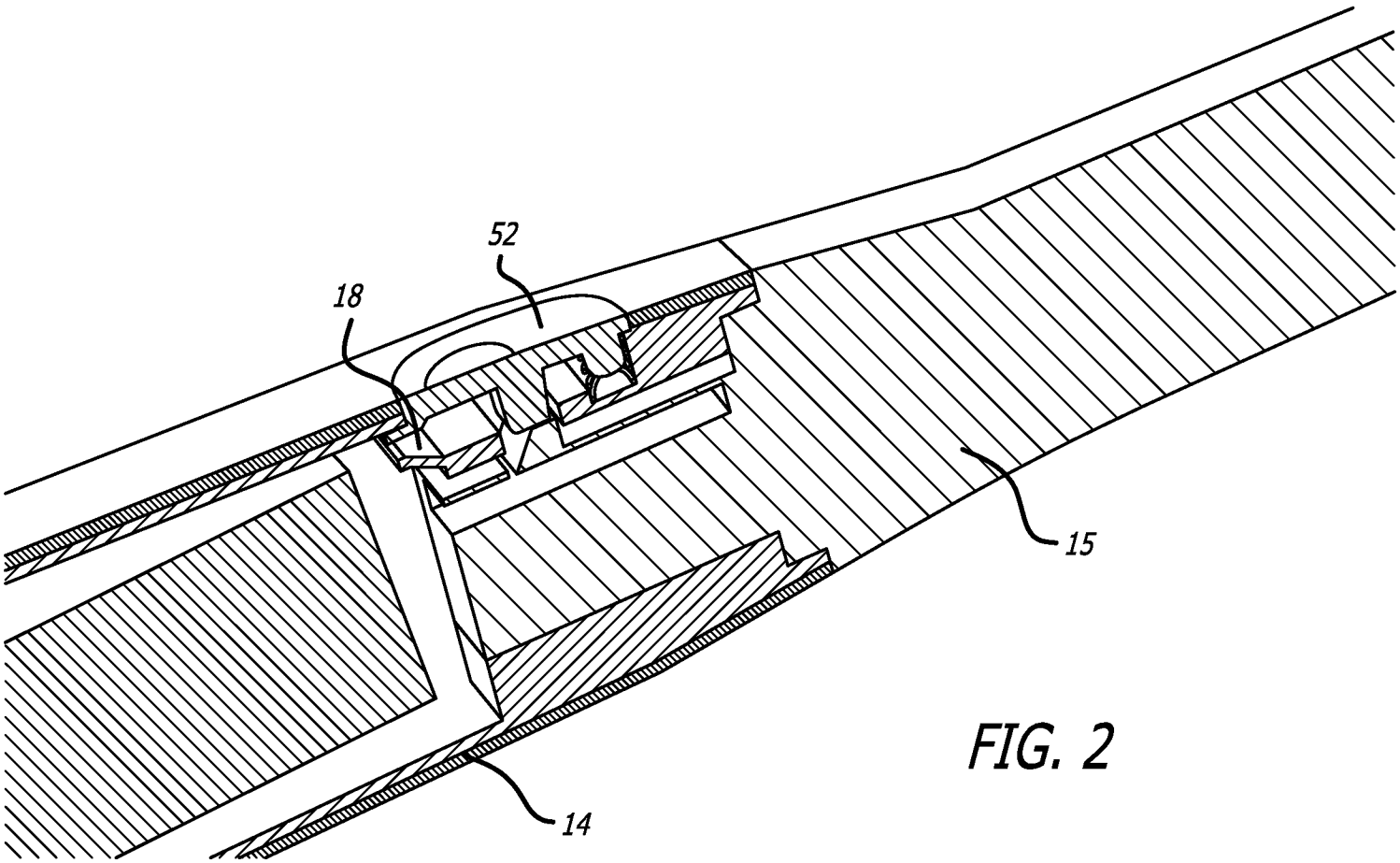
FIG. 2 is a cutaway closeup view of the massager of FIG. 1, in the area where the extension handle mates with one of the handle portions.

FIG. 2 is a cutaway closeup view of the massager 10 of FIG. 1, in the area where the extension handle 15 mates with second handle portion 14. In this embodiment biased locking tab 18 on extension handle 15 engages second handle portion 14. When a user presses down on release button 52, locking tab 18 disengages from second handle portion 14 and the extension handle can be removed. Other mechanisms for releasably mating two pieces together are well known and could be substituted.

Figure 3:
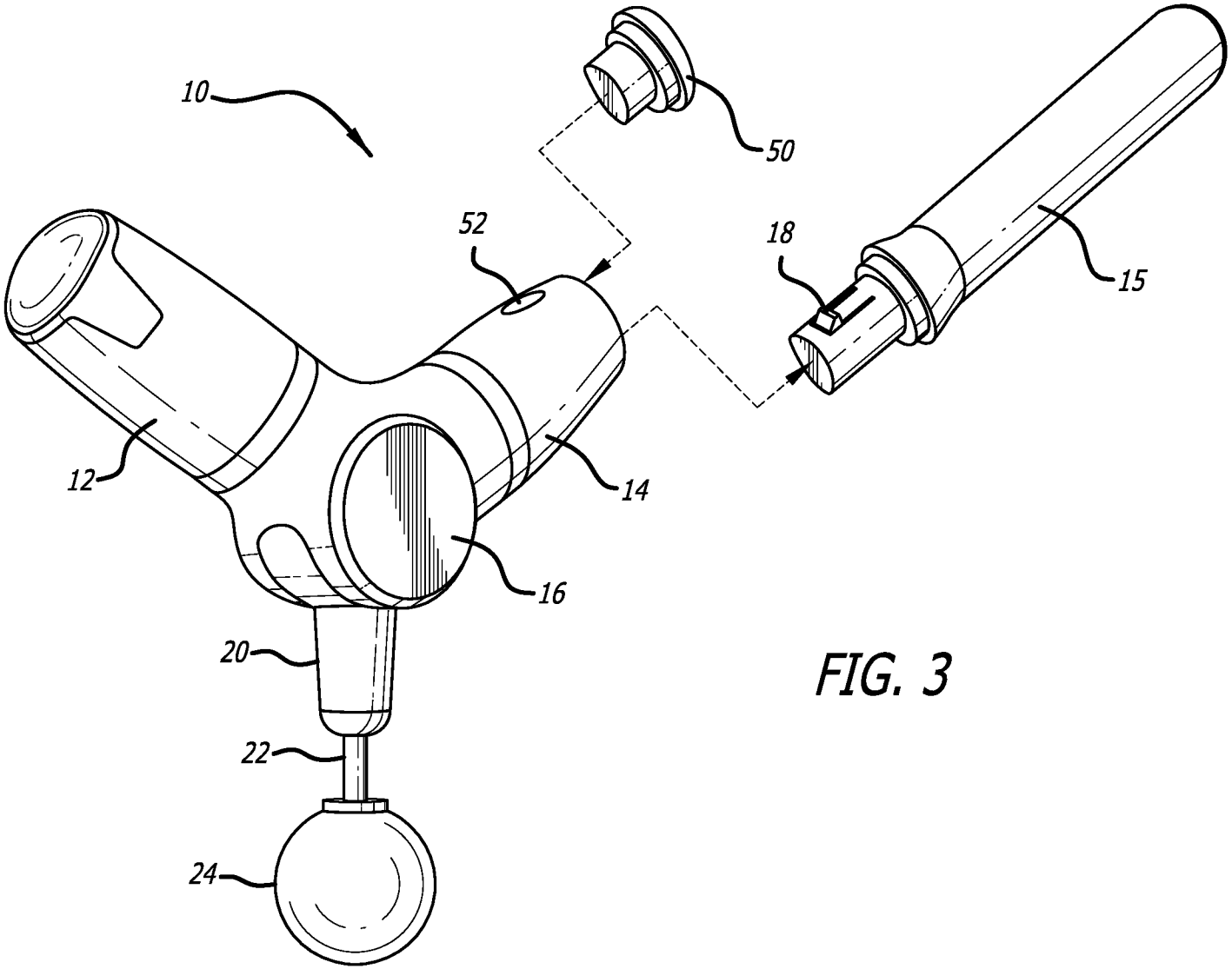
FIG. 3. is an exploded view of the massager of FIG. 1 including both the extension handle and an end cap for when the extension handle is not present.

FIG. 3. is an exploded view of the massager 10 of FIG. 1 including both the extension handle 15 and an end cap or cover 50 for when the extension handle is not being used. The releasable extension handle allows a user to quickly change the massager between the configuration shown in FIG. 1 with the extension handle, to the configuration shown in FIG. 4 without the extension handle. As will be shown and described in greater detail later, the extension handle allows the user to effectively apply the massager to places on his body otherwise not possible for a solo user, and to reach other places more easily and ergonomically.

Figure 4:
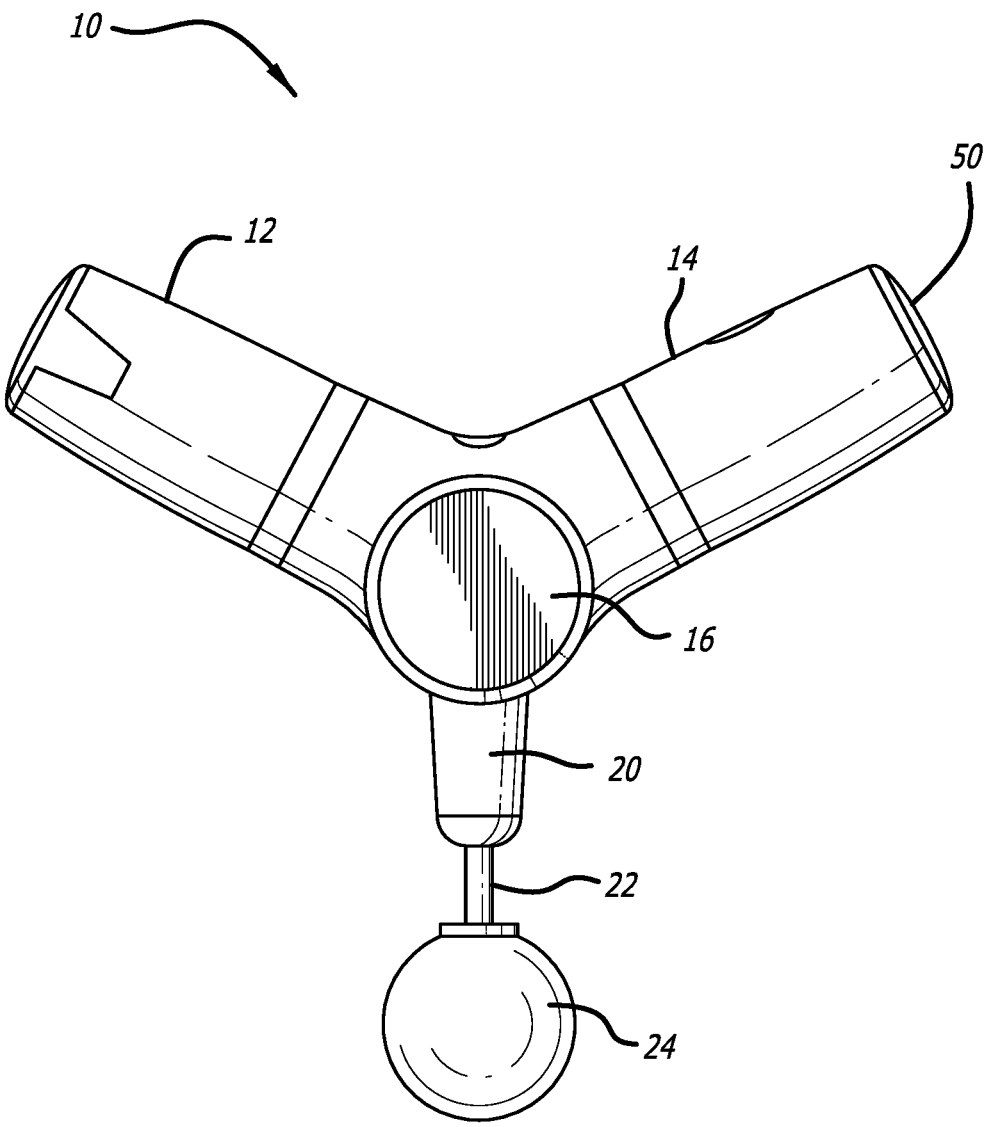
FIG. 4. is a front elevation view of the massager of FIG. 1 with the end cap installed in place of the extension handle.

FIG. 4. is a front elevation view of the massager 10 of FIG. 1 with end cap 50 installed in place of extension handle 15. End cap 50 maintains a clean and aesthetic appearance of the massager with smoothly curved edges when extension handle 15 is not present.

Figure 5:
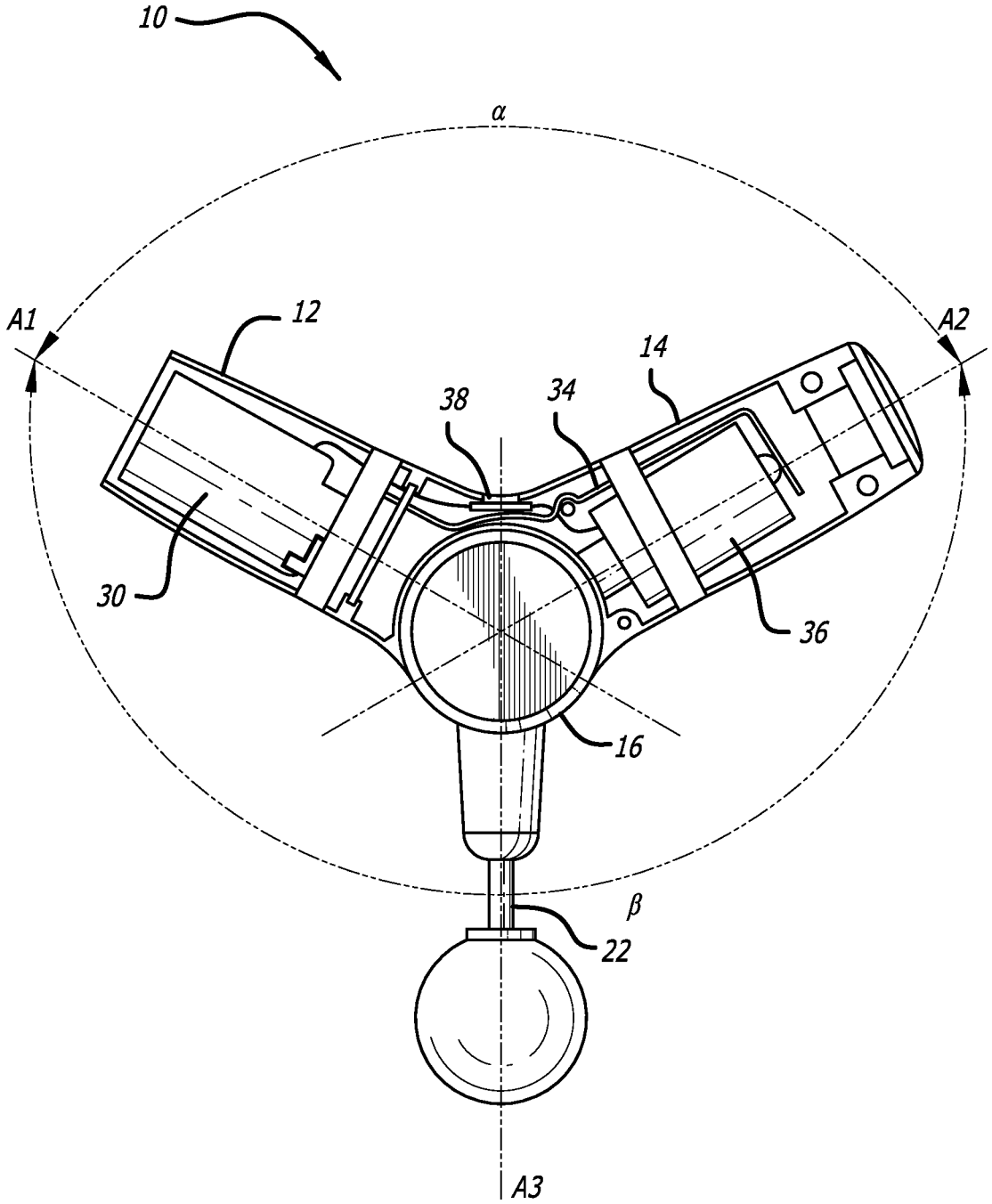
FIG. 5. is a cutaway view of the massager of FIG. 4.

FIG. 5. is a cutaway view of the massager of FIG. 4. In this figure the following parts can be seen: battery 30; an associated electrical ON/OFF switch 38; electrical wire(s) 34; and an electric drive motor 36. Battery 30 is disposed within first handle portion 12, and electric drive motor 36 is disposed within second handle portion 14. In this context, "disposed within" means disposed at least partially within. Battery 30 is preferably a rechargeable battery that is chargeable through either a wired charging port (not shown) or a wireless charging system. Alternatively, battery 30 could be a non-rechargeable, replaceable battery. With battery 30 in the first handle portion 12 and motor 36 in second handle portion 14, and the gearing in the central portion 16 (FIG. 6), massager 10 is evenly balanced in weight between its left and right sides. "Evenly balanced" can mean that the weights of the two handle portions and hence the two sides are within 5% of each other, or within 10% of even other, or within 20% of each other.

First handle portion 12 has a longitudinal axis A1. Likewise, second handle portion 14 has a longitudinal axis A2. Reciprocating output shaft 22 which extends from the central portion 16 of body 11 has an associated axis of reciprocation A3. Output shaft 22 is operatively coupled to the electric drive motor to produce linear reciprocating motion at output shaft 22 and at percussive massage head 24 affixed to the distal end of output shaft 22.

The first and second handle portions 12, 14 and their associated longitudinal axes A1, A2 define an obtuse angle that defines minor arc α between them, and also define a major arc β. Minor arc α defines an angle of less than 180° and preferably less than 160°, but more than 75°, and preferably more than 90°, more than 100°, more than 110°, less than 130°, and more preferably still the minor arc α between the first and second handle portions defines an angle of approximately 120°. In the nominal position for massager 10 shown in the figure, the massager has a Y-shape, with reciprocating axis A3 being within and bifurcating major arc β, and defining an angle of 120° with each of first axis A1 and second axis A2.

Figure 6:
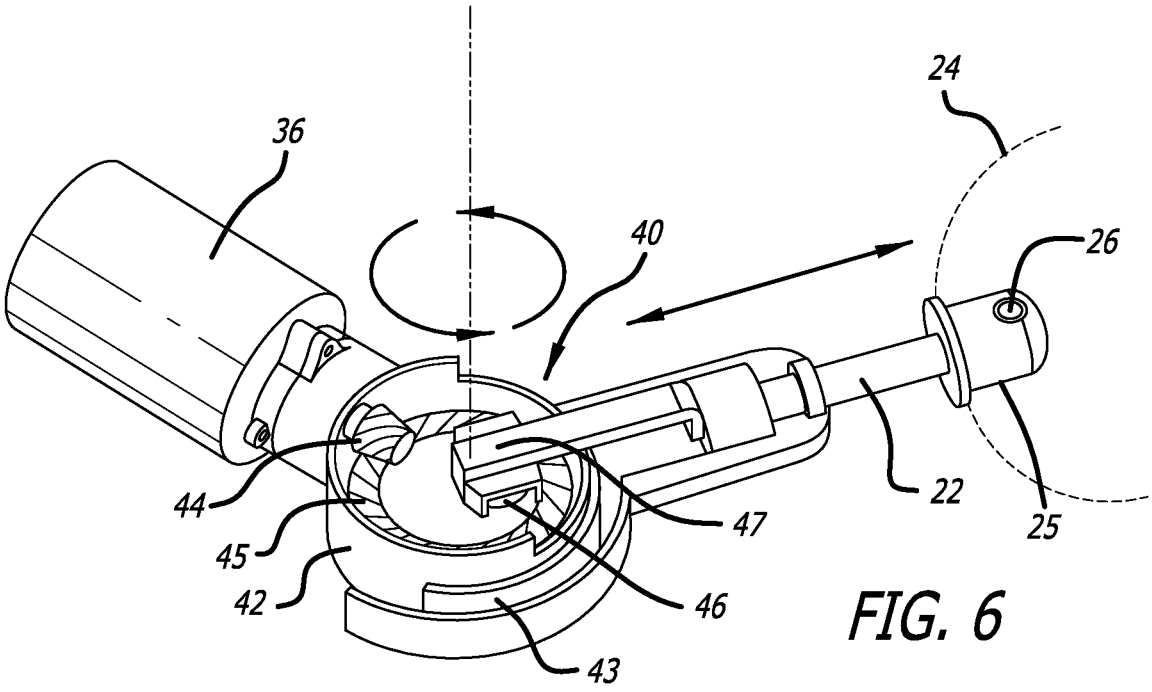
FIG. 6. is a partial perspective view showing an internal gearing and a rotation mechanism of the massager of FIG. 1, and showing the massager output shaft at its distal-most extension.

FIG. 6. is a partial perspective view showing an internal gearing mechanism and a rotation mechanism 40 of the massager of FIG. 1, and showing the massager output shaft 22 at its distal-most extension. Rotation mechanism 40, which constitutes a type of hinge, allows output shaft 22 to rotate or pivot relative to body 11 of the massager 10 including relative to first and second handle portions 12, 14.

Rotation mechanical 40 includes a generally circular inner housing or hub 42 rotating within a generally circular outer housing or hub 43. Inner housing 42 is rotationally fixed to the handle portions 12, 14. The output shaft 22 is rotationally fixed to outer housing 43, such that as the inner and outer housings rotate relative to one another, output shaft 22 rotates or pivots relative to the handle portions 12, 14. The result is that the output shaft 22 can rotate to a user-selected angle relative to the first and second handle portions 12, 14.

A gearing mechanism housed within inner housing 42 translates rotational output from motor 36 to reciprocating output at reciprocating output shaft 22, so as to operatively couple electric drive motor 36 to produce linear reciprocating motion at output shaft 22 including at a distal end thereof. The gearing includes a first spiral bevel gear 44 which is directly coupled to the output of motor 36, and a second spiral bevel gear 45 which meshes with first spiral bevel gear 44. As bevel gears 44 and 45 rotate, crank pin 46 moves in a circular path as shown. Connecting rod 47 is connected to crank pin 46 such that as crank pin 46 moves in a circular path, connecting rod 47 moves in both circular and reciprocating motion, and output shaft 22 which is driven by connecting rod 47 moves in a linear reciprocating motion. This type of gearing and mechanism for translating circular motion to reciprocating motion is, by itself, well known. Additional details of the mechanism that are not shown or described herein will be apparent to those of skill in the mechanical engineering arts.

Also seen in the figure is a shaft head 25 on output shaft 22 having a spring-biased button 26. These features allow a variety of different massage heads such as massage ball 24 to be easily installed on massager 10 and removed for quick and easy interchangeability of massage heads, in much the same way that sockets are quickly and easily changed on a socket wrench. Other mechanisms including other quick-change mechanisms are possible to allow the massage heads to be easily changed.

Figure 7:
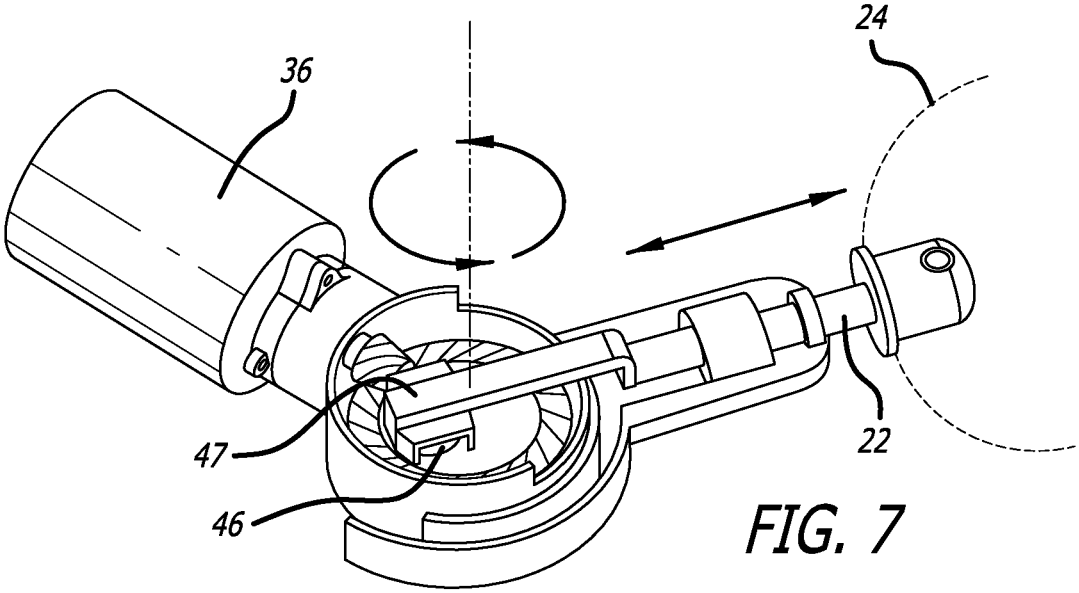
FIG. 7. is the same view as FIG. 6. but showing the massager output shaft at its proximal-most position.

FIG. 7. is the same view as FIG. 6. but showing the massager output shaft 22 at its proximal-most position. As second spiral bevel gear 45 rotates, output shaft 22 and percussive massage head 24 reciprocate, delivering a percussive massage to the user.

Figure 8:
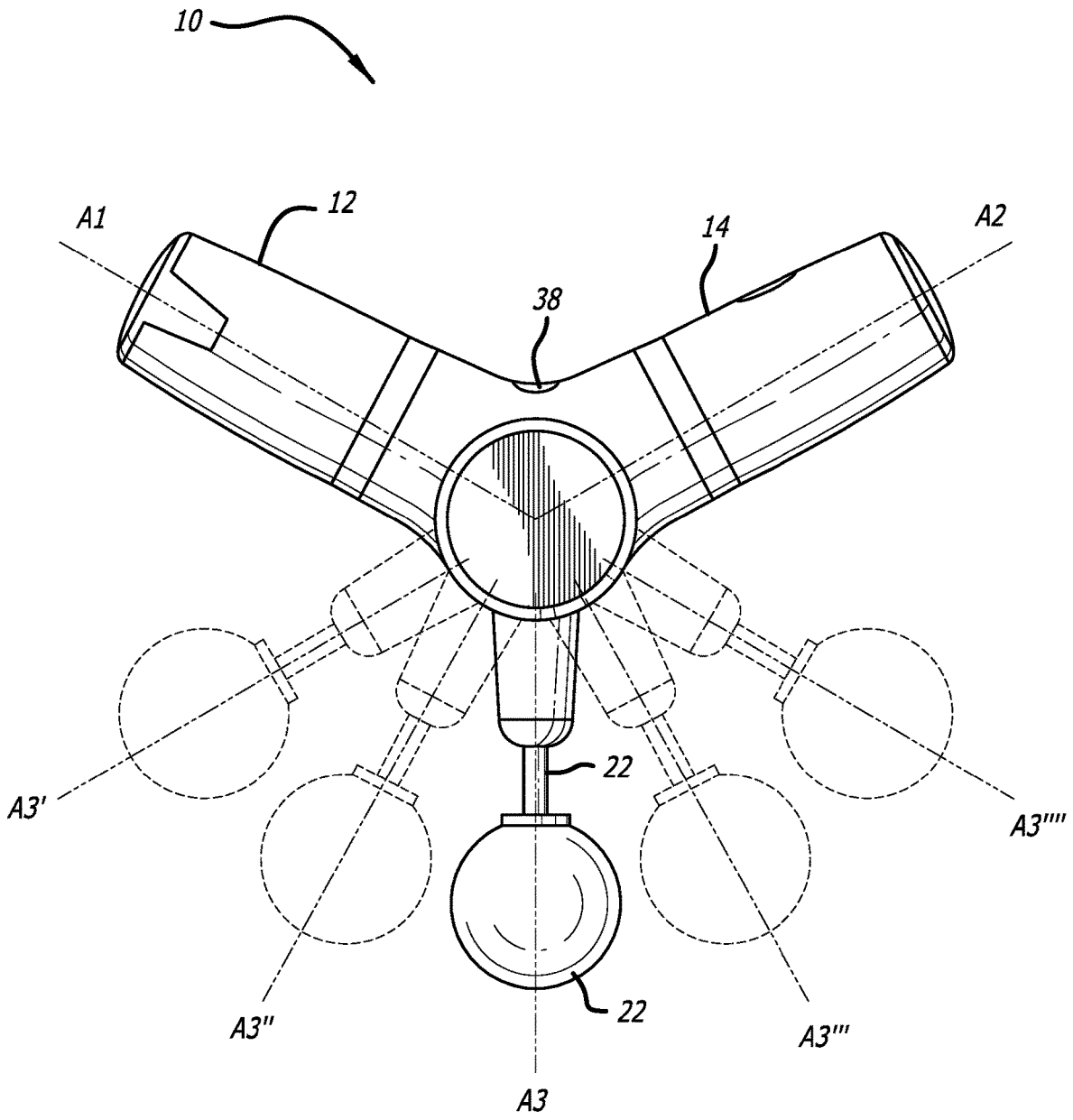
FIG. 8. is a front elevation view of the massager of FIG. 4, and showing in ghost lines different positions into which the output shaft can be rotated and locked.

FIG. 8. is a front elevation view of the massager of FIG. 4, and showing in ghost lines different positions into which output shaft 22 and associated massage head 24 can be rotated and locked. Five positions are shown, showing reciprocating axis A3 at five different orientations, namely, A3, A3', A3", A3'", and A3"". The mechanism can be continuously pivoted through that range of angles, and in the illustrative embodiment can be locked into any of the five positions shown.

Figure 9:
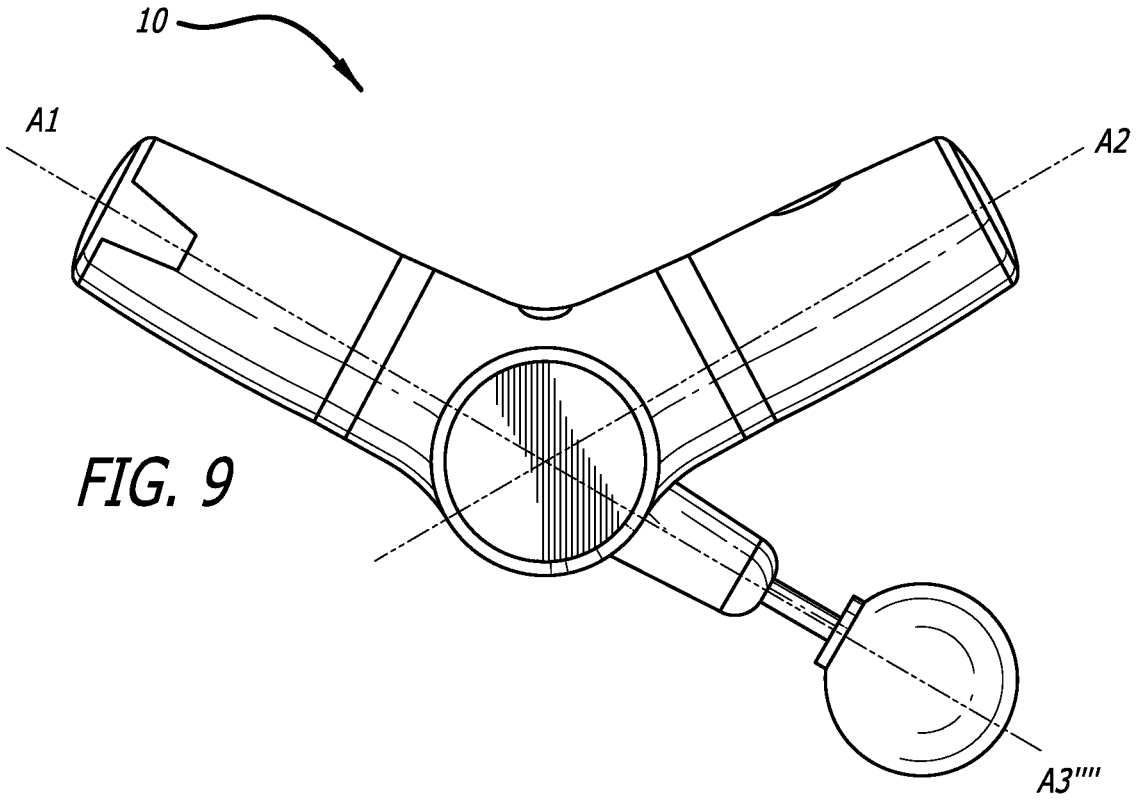
FIG. 9. is a front elevation view of the massager of FIG. 4, showing the massager output shaft rotated so that it is in line with the longitudinal axis A1 of the first handle section.

FIG. 9. is a front elevation view of the massager 10 of FIG. 4, showing the massager output shaft 22 rotated so that reciprocating axis A3 is in line with the longitudinal axis A1 of the first handle section. More generally, A1 and A3 are parallel and may be, but need not be, in line. Output shaft 22 can be locked into this position.

Figure 10:
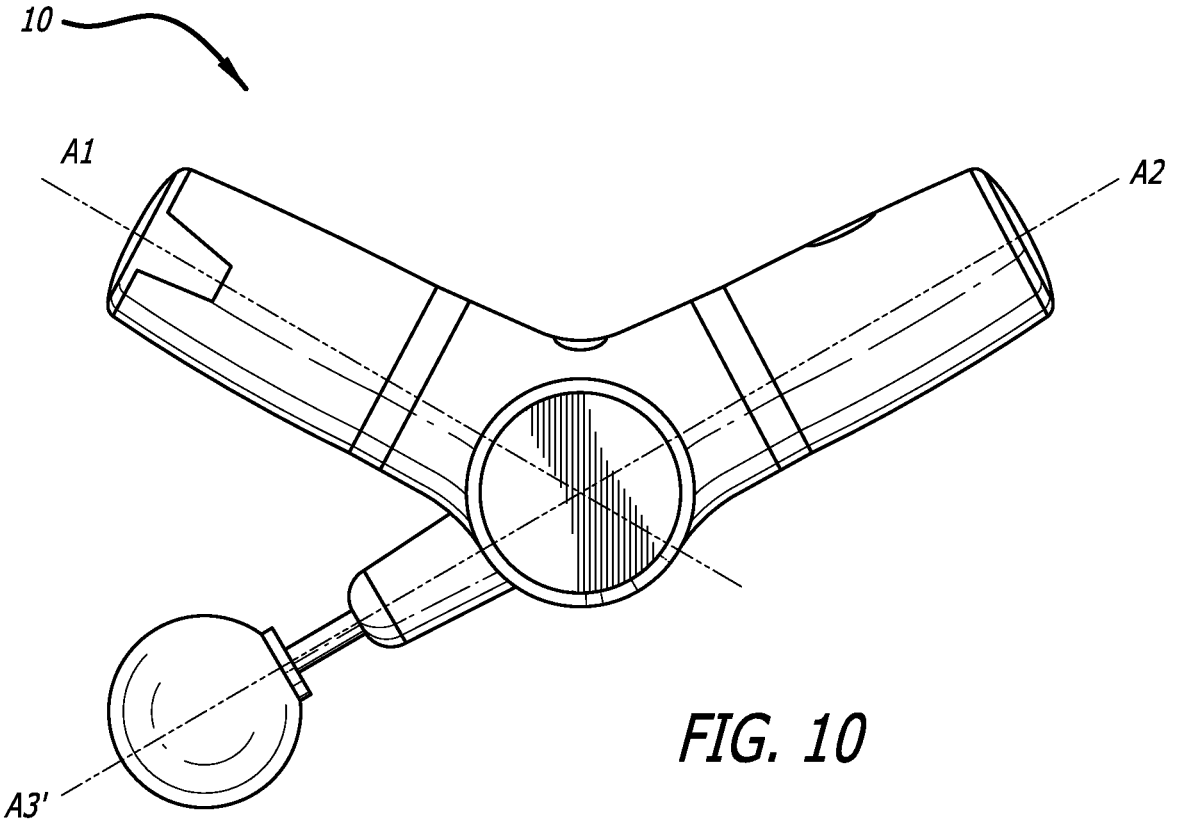
FIG. 10. is a front elevation view of the massager of FIG. 4, showing the massager output shaft rotated so that it is in line with the longitudinal axis A2 of the second handle section.

FIG. 10. is a front elevation view of the massager 10 of FIG. 4, showing the massager output shaft 22 rotated so that it is in line with the longitudinal axis A2 of the second handle section. More generally, A1 and A2 are parallel but need not be exactly in line. Output shaft 22 can be locked into this position. Output shaft 22 and associated reciprocating axis A3 can thus be rotated through an angle of more than 90°, and preferably more than 100° and 110°, and in this embodiment through a full 120° to be parallel with either handle portion 12, 14 and their associated axes A1, A2. When the extension handle 15 (FIG. 1) is attached, therefore, reciprocating axis A3 can either form an acute angle of approximately 60° with extension handle 15 as it would in FIG. 9 if the extension handle were attached, or can be parallel and in line with extension handle 15 as it would be in FIG. 10.

Figure 11:
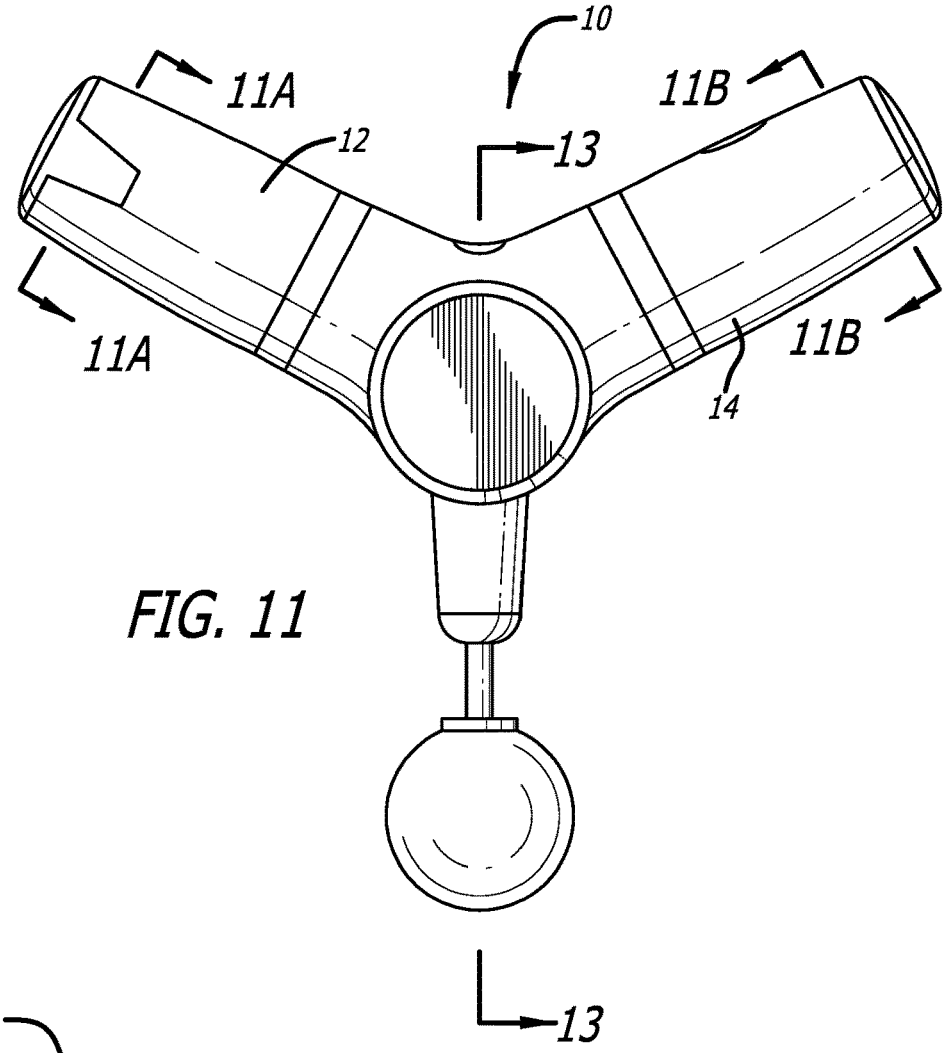
FIG. 11. is a front elevation view of the massager of FIG. 4.
Figure 11A:
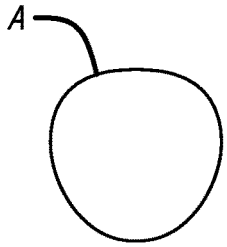
FIG. 11A is a cross-sectional view of the massager of FIG. 11 taken along section line A-A.
Figure 11B:
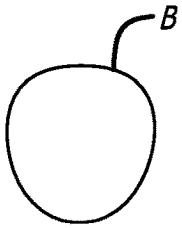
FIG. 11B is a cross-sectional view of the massager of FIG. 11 taken along section line B-B.
Figure 11C:
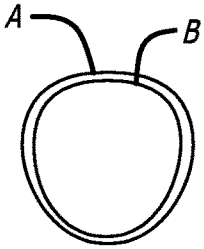
FIG. 11C shows the two cross-sections shown in FIGS. 11A and 11B superimposed.

FIG. 11. is a front elevation view of the massager 10 of FIG. 4. FIG. 11A is a cross-sectional view of the massager of FIG. 11 taken along section line A-A, and FIG. 11B is a cross-sectional view of the massager of FIG. 11 taken along section line B-B taken at a corresponding position on the handle portion, i.e., taken at the same distance from a midpoint of the device, and taken the same distance from the respective distal ends of the handle portions 12, 14. FIG. 11C is a cross-sectional view of the massager of FIG. 11 showing the cross-sections taken along taken along section lines A-A and B-B superimposed. As can be seen in these figures, the cross-section A of first handle portion 12 has a greater circumference than does cross-section B of second handle portion 14. This difference in handle sizes allow users having different sized hands to primarily use the handle portion that best matches their hand sizes. The difference in circumferences can be greater than 10%, and greater than 20%, in order to ergonomically accommodate different sized hands.

Figure 12:
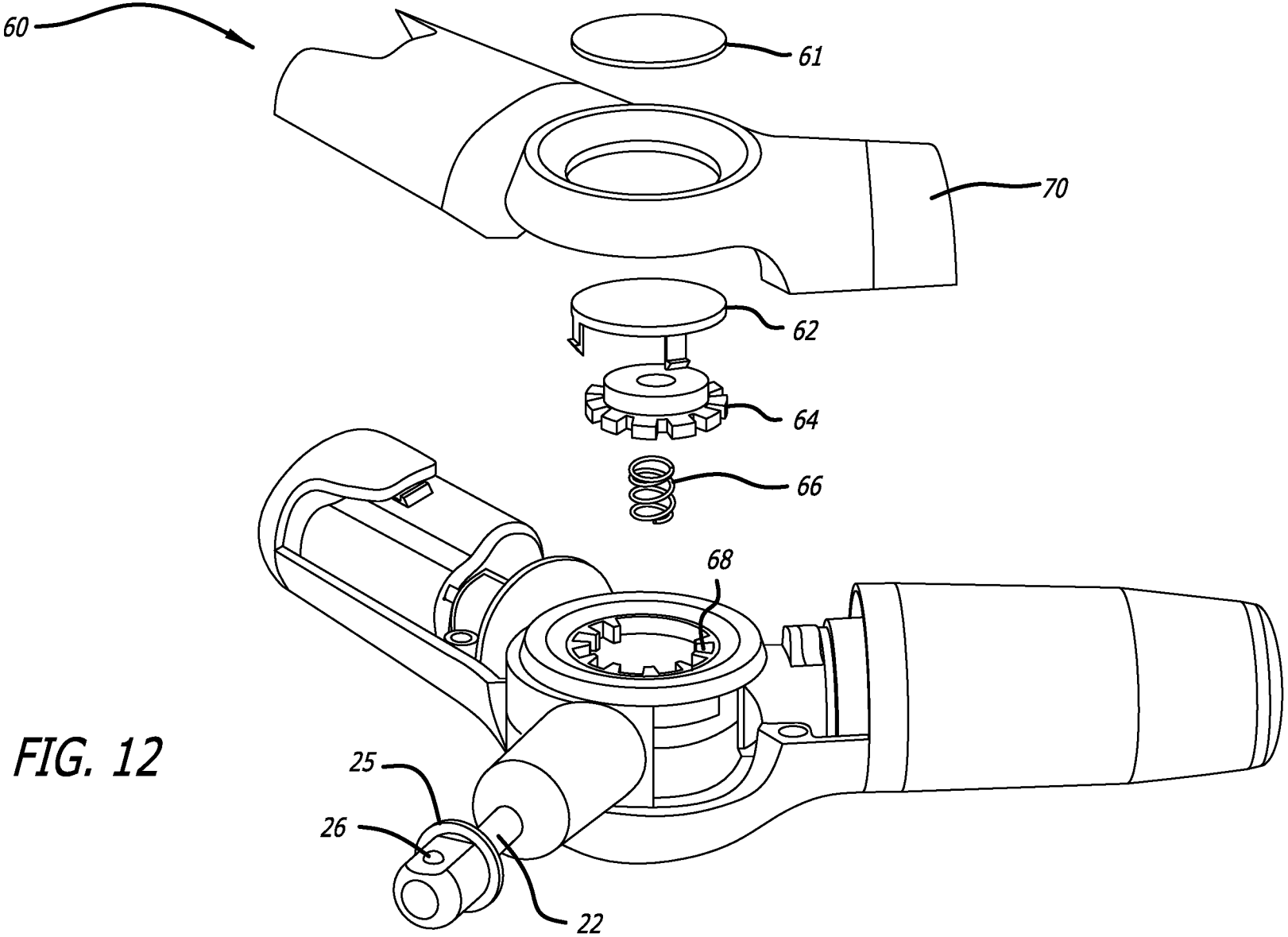
FIG. 12 is partially exploded view of the massager of FIG. 4, showing the rotation locking mechanism in exploded form.

FIG. 12 is partially exploded view of the massager of FIG. 4, showing the rotation locking mechanism 60 in exploded form. Not explicitly shown in the figure is that a number of teeth similar to teeth 68 are formed integral with or affixed to housing cover 70 on the underside thereof. In the nominal state of the massager, toothed sprocket 64 is biased by spring 66 up against sprocket retention cap 62. In that position the teeth of sprocket 64 engage both at least a first tooth 68 on massager body 11 which are rotationally coupled to output shaft 22, and at least a second tooth from among teeth 72 on housing cover 70. In that position sprocket 64 rotationally locks tooth 68 to at least a second tooth 72, and thus rotationally locks output shaft 22 at a specified rotational position relative to housing cover 70 and hence body 11.

When a user presses decorative cap 61 which acts as a lock release push button, sprocket 64 is pressed against spring 66 to thereby compress spring 66. Sprocket 64 moves downward so that it no longer engages teeth 72. In that position sprocket 64 and teeth 68 are free to rotate relative to teeth 72, and hence output shaft 22 is free to rotate relative to body 11. When output shaft 22 is in the position desired by the user, he releases push button 61 thereby locking output shaft 22 into position. Other releasable locking mechanisms are possible.

Figure 13:
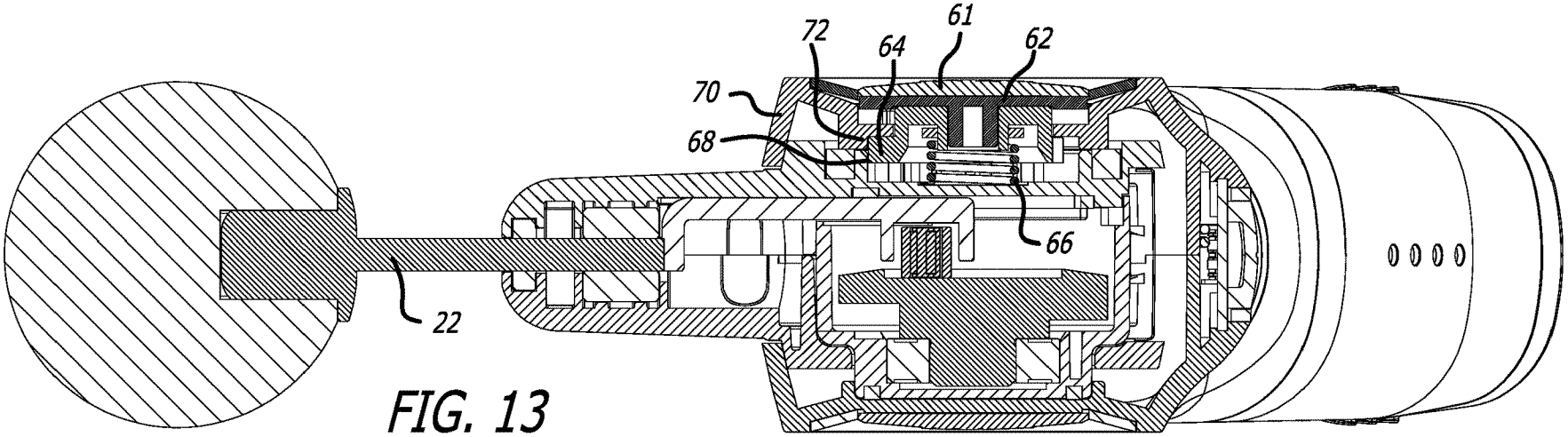
FIG. 13 is a sectional view of the massager of FIG. 12 but non-exploded, showing the rotation locking mechanism in its locked position.

FIG. 13 is a sectional view of the massager of FIG. 12 but non-exploded, showing the rotation locking mechanism in its locked position, i.e., its unpressed position. In this position the teeth of sprocket 24 mesh with both teeth 68 and teeth 72, preventing rotation.

Figure 14:
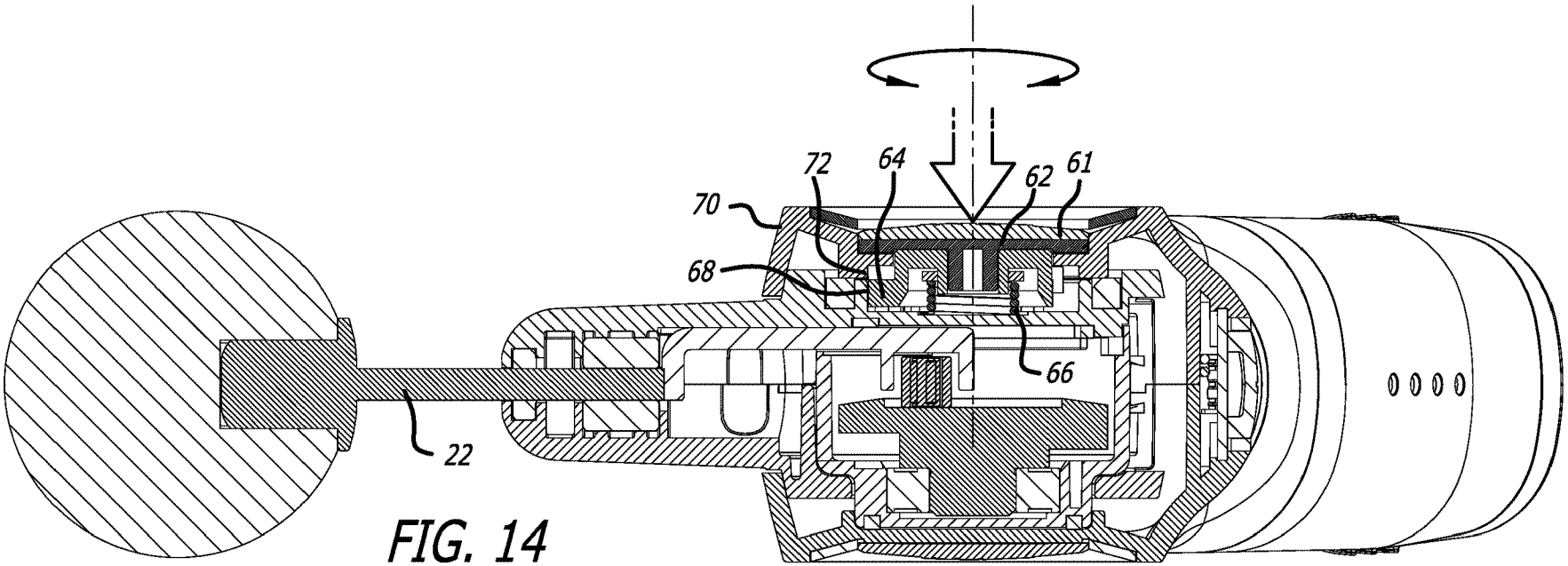
FIG. 14 is a sectional view of the massager of FIG. 12 but non-exploded, showing the rotation locking mechanism in its unlocked position.

FIG. 14 is a sectional view of the massager of FIG. 12 but non-exploded, showing the rotation locking mechanism in its unlocked position, i.e., when release push button 61 is pressed. In this position sprocket 24 is displaced downward such that it meshes with teeth 68 but not with teeth 72, allowing rotation.

FIGS. 15-20 illustrate a number of uses of the device to apply a percussive massage to various parts of the body. It is believed that the uses shown were not possible or at least not as easily achieved with any prior art percussive massagers.

Figure 15:
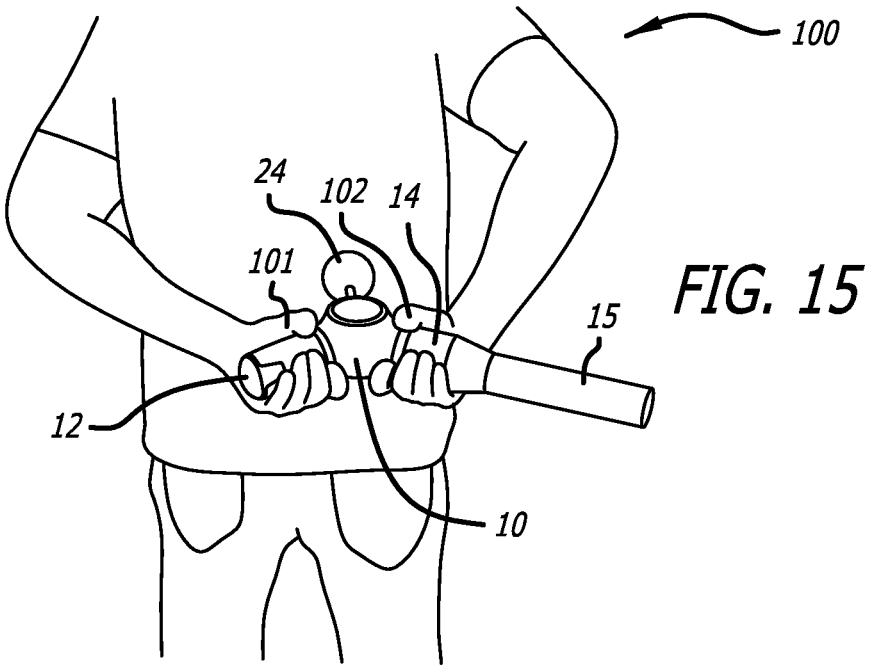
FIG. 15. is a rear view of a user using the massager of FIG. 1 according to a first possible use thereof.

FIG. 15. is a rear view of a user using the massager of FIG. 1 according to a first possible use thereof. In this use the pivot mechanism is in its nominal position such that the massager 10 has a Y-shaped configuration. The user 100 holds the first handle portion 12 in the user's first hand 101, and the second handle portion 14 in the user's second hand 102. As can be seen in the figure, the handle portions are angled so that the massager is suitable for being comfortably, naturally, and ergonomically held by first and second hands of a user while holding the percussive electric massage appliance behind the user's back, and in particular the user's lower back, while the percussive massage head 24 repeatedly impacts lower back muscles of the user. The user can thus comfortably hold the percussive massage appliance 10 with both hands while delivering to himself a percussive massage via reciprocating action of the percussive massage head. In this position the user can pull the device toward his own back using a pulling motion which allows the user to pull the massager against his back with significant force. This operation is optimum for delivering a percussive massage to an area of the back near or adjacent to the spine.

Figure 16:
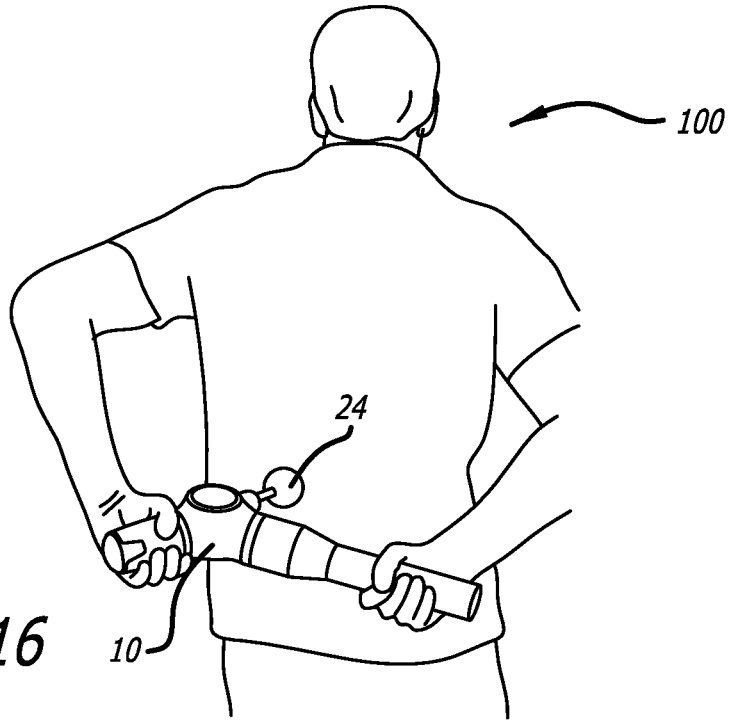
FIG. 16. is a rear view of a user using the massager of FIG. 1 according to a second possible use.

FIG. 16. is a rear view of a user using the massager of FIG. 1 according to a second possible use. The massager 10 has its output shaft 22 and the massage ball 24 attached thereto pivoted so that the reciprocation axis A3 is in-line with the longitudinal axis A1 of first handle portion 12, similar to the rotational position shown in FIG. 9. In this position the user can pull the massager toward him with significant force using his left hand, while using his right hand and extension handle 15 for stability. It is anticipated that this configuration would be used to provide a massage to a portion of the back that is farther away from the spine than shown in FIG. 15.

Figure 17:
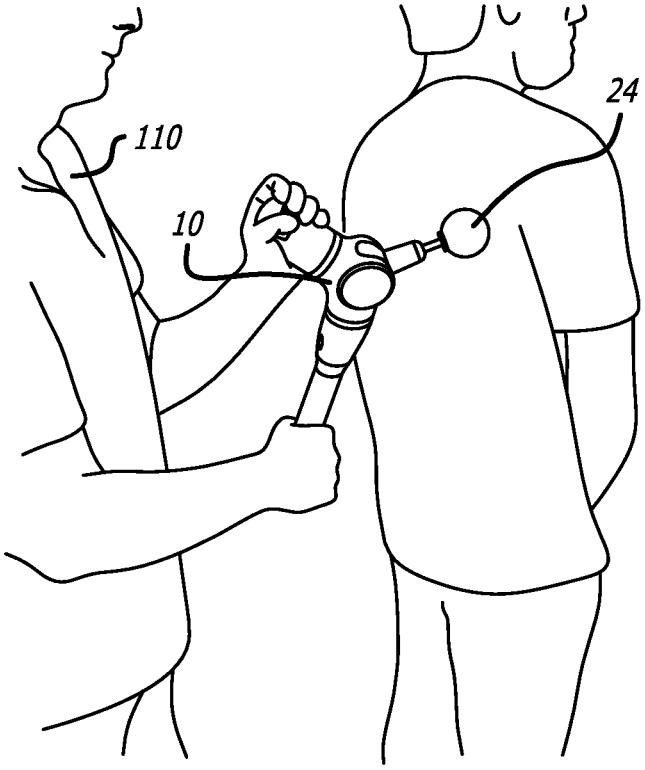
FIG. 17. is a perspective view of a therapist using the massager of FIG. 1 on a patient according to a third possible use.

FIG. 17. is a perspective view of a therapist 110 using the massager of FIG. 1 on a patient according to a third possible use. The two handles allows the therapist to apply the massage with significant force, and the relatively large distance between the locations where the therapist is gripping the device allow for significant stability so that the massager 10 does not easily slip away from its intended position and the targeted spot on the patient's body.

Figure 18:
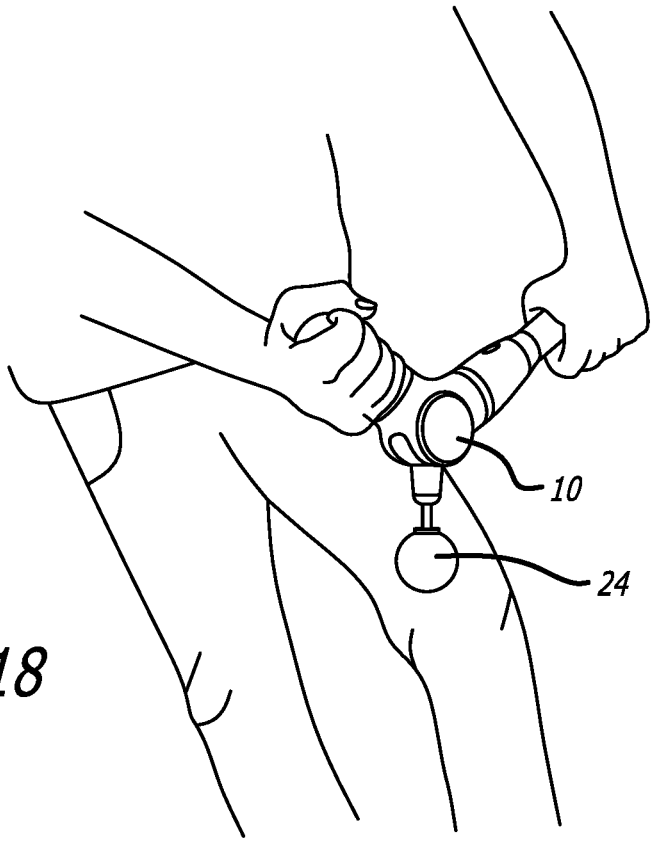
FIG. 18. is a perspective view of a user using the massager of FIG. 1 according to a fourth possible use.

FIG. 18. is a perspective view of a user using the massager of FIG. 1 according to a fourth possible use. Again, the two handles allow the massage to be applied with significant force, and the wide handle distance provides stability.

Figure 19:
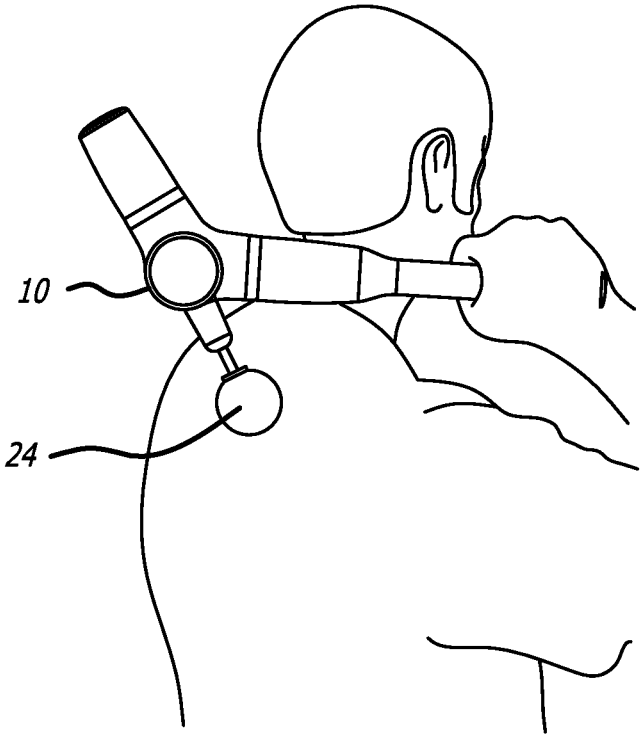
FIG. 19. is a perspective view of a user using the massager of FIG. 1 according to a fifth possible use.

FIG. 19. is a perspective view of a user using the massager of FIG. 1 according to a fifth possible use. The acute angle between output shaft 22 and the extension handle 15 enables a hooking action in which the user uses his right hand on extension handle 15 to pull the massager 24 toward the target location on his back, thus allowing the user to apply the massager with significant force against his own back. In this position the user could also use his left hand to help guide and steady the massager.

Figure 20:
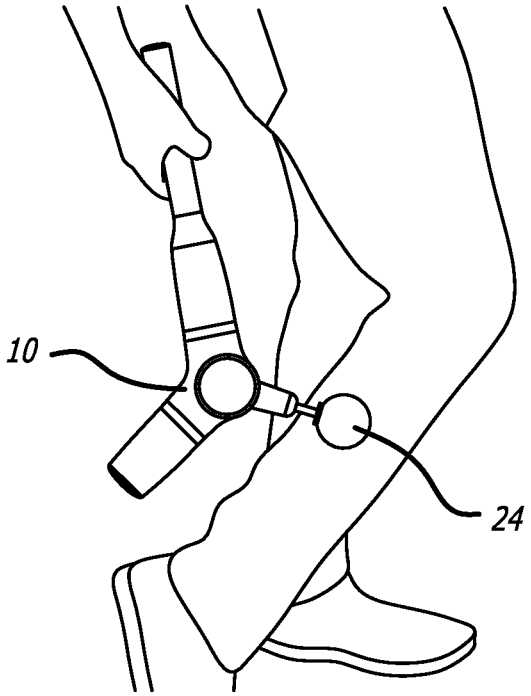
FIG. 20. is a perspective view of a user using the massager of FIG. 1 according to a sixth possible use.

FIG. 20. is a perspective view of a user using the massager of FIG. 1 according to a sixth possible use. The extension handle 15 allows the massage head 24 to reach places on the body that otherwise would have required more bending or contortion by the user, including a calf muscle as shown, as well as the soles of the feet.

Although not illustrated, the massager would also allow a seated user to pull the percussive massager 10 against the back of his thigh muscles with significant force, delivering a result that had not been previously achieved or at least not as easily achieved.

The massager of the present invention thus provides a versatile and ergonomic percussive massage to a user, with the user being able to use the device to deliver percussive massage to various target areas on his body more easily and with more stability and force, than with prior art massagers.

It will be understood that the terms "generally," "approximately," "about," "substantially," and "parallel" as used within the specification and the claims herein allow for a certain amount of variation from any exact dimensions, measurements, and arrangements, and that those terms should be understood within the context of the description and operation of the invention as disclosed herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

It will be appreciated that the term "present invention" as used herein should not be construed to mean that only a single invention having a single essential element or group of elements is presented. Similarly, it will also be appreciated that the term "present invention" encompasses a number of separate innovations and features which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. For example, the massager could include the standard feature of a variable speed motor and associated variable speed control. Additionally, the massager could be modified to give it a variable reciprocating stroke length.

Still further, the massage could operate from battery power and/or wall power such as 120 VAC.

Accordingly, it is to be understood that the detailed description and the accompanying drawings as set forth hereinabove are not intended to limit the breadth of the present invention, which should be inferred only from the following claims and their appropriately construed legal equivalents.

We claim:

1. A percussive electric massage appliance comprising:

a body, the body comprising:

a central portion;

a first handle extending away from the central portion along a first axis, the first handle being suitable for grasping by a first hand of an operator; and a second handle extending away from the central portion along a second axis such that the first handle and the second handle form an obtuse angle thus defining a minor arc and a major arc between the first handle and the second handle, the second handle being suitable for grasping by a second hand of the operator while the operator is also grasping the first handle in the operator's first hand;

an electric drive motor assembly disposed at least partially within the body, the electric drive motor assembly including at least an electric drive motor;

an output shaft extending from the central portion of the body within the major arc between the first handle and the second handle, the output shaft being operatively coupled to the electric drive motor to produce linear reciprocating motion at a distal end of the output shaft; and a rotation mechanism that enables the output shaft to rotate relative to the first handle and the second handle, such that the percussive massage appliance can be used to deliver a percussive massage while the output shaft is positioned at a user-selectable angle relative to the first handle and the second handle;

wherein the first axis and the second axis intersect at a point within the rotation mechanism;

wherein the output shaft defines a reciprocation axis;

wherein the rotation mechanism is configured to enable the output shaft to rotate so that, in a first position, the reciprocation axis extends within the first handle and parallel to the first axis; and wherein the rotation mechanism is further configured to enable the output shaft to rotate so that, in a second position, the reciprocation axis extends within the second handle and parallel to the second axis.

2. The percussive electric massage appliance of claim 1 wherein said rotation mechanism allows the output shaft to rotate by more than 90 degrees.

3. The percussive electric massage appliance of claim 1, wherein the first and second positions define an angle of greater than 110 degrees therebetween.

4. The percussive electric massage appliance of claim 1 further comprising a lock for locking the rotation mechanism in a desired rotational position.

5. The percussive electric massage appliance of claim 4 wherein said rotation lock comprises:

a toothed sprocket;

at least a first tooth rotationally affixed to said body;

at least a second tooth rotationally affixed to said output shaft;

a spring that biases the sprocket toward a position of engagement with said teeth;

a push button coupled to the sprocket such that pushing the button presses the sprocket against the bias to move the sprocket away from engagement with at least one of said teeth, allowing the first and second teeth to rotate relative to one another;

whereupon when said push button is released the bias moves the sprocket back into engagement with both of said first and second teeth thereby locking the first and second teeth into a fixed rotational position with each other, thereby locking the output shaft into a fixed rotational position relative to the body.

6. The percussive electric massage appliance of claim 1 wherein the first handle has a first circumference at a first distance along the first axis from the central portion, the second handle has a second circumference at a second distance along the second axis from the central portion, and the first circumference differs from the second circumference by greater than 10%.

7. The percussive electric massage appliance of claim 1 further comprising an extension handle, the extension handle releasably engaging at least one of the first handle and the second handle in order to provide a removable extension thereof.

8. The percussive electric massage appliance of claim 1 further comprising a battery within the first handle, and wherein the electric drive motor is disposed within the second handle.

9. The percussive electric massage appliance of claim 1, wherein the first handle and the second handle extend symmetrically with respect to the central portion.

10. The percussive electric massage appliance of claim 1, wherein the first handle and the second handle are connected only at the central portion.

11. The percussive electric massage appliance of claim 1, wherein:

the rotation mechanism enables the output shaft to rotate about a third axis extending perpendicularly to both the first axis and the second axis; and both the first axis and the second axis intersect the third axis.

12. The percussive electric massage appliance of claim 1, wherein:

the rotation mechanism is configured to enable the output shaft to rotate so that the output shaft can be positioned to extend along the first axis; and the rotation mechanism is further configured to enable the output shaft to rotate so that the output shaft can be positioned to extend along the second axis.

13. A percussive electric massage appliance comprising:

a central portion;

a reciprocating member extending from the central portion;

a percussive massage head affixed to a distal end of the reciprocating member;

an electric motor operatively connected to and driving the reciprocating member such that the reciprocating member reciprocates, motion of the reciprocating member defining a reciprocation axis;

a first handle connected to and extending away from the central portion along a first axis and a second handle connected to and extending away from the central portion along a second axis, such that the first handle, the second handle, and the reciprocation axis define a Y-shape; and a hinge to which the reciprocating member is mounted such that the reciprocation axis relative to the first handle and the second handle can be varied;

wherein the first axis and the second axis intersect at a point within the hinge;

wherein the first handle and the second handle define an obtuse angle therebetween; and wherein the user can hold the percussive massage appliance with both hands while self-administering a percussive massage via reciprocating action of the percussive massage head.

14. The percussive electric massage appliance of claim 13 wherein said obtuse angle is greater than 100 degrees and less than 160 degrees.

15. The percussive electric massage appliance of claim 14 wherein said obtuse angle is greater than 110 degrees and less than 130 degrees.

16. The percussive electric massage appliance of claim 13, wherein:

said hinge comprises:

a generally circular outer housing; and an inner housing that rotates within said outer housing; and wherein the percussive electric massage appliance further comprises gears that translate rotational motion from the electric motor to reciprocating motion of the reciprocating member, said gears being housed within said central portion.

17. The percussive electric massage appliance of claim 13, wherein the hinge allows the reciprocation axis to be rotated through an angle of more than 100 degrees.

18. The percussive electric massage appliance of claim 13 wherein:

said first handle and said second handle portions have different circumferences.

19. The percussive electric massage appliance of claim 13, wherein:

the hinge allows the reciprocating member to rotate so that, in a first position, the reciprocation axis extends within the first handle portion; and the hinge further allows the reciprocating member to rotate so that, in a second position, the reciprocation axis extends within the second handle.

20. The percussive electric massage appliance of claim 19, wherein:

in the first position, the reciprocation axis extends parallel to the first axis; and in the second position, the reciprocation axis extends parallel to the second axis.

21. A percussive electric massage appliance comprising:

a body, the body comprising:

a central portion;

a first handle extending away from the central portion along a first axis, the first handle being suitable for grasping by a first hand of an operator; and a second handle extending away from the central portion along a second axis that forms an obtuse angle with the first axis, the second handle being suitable for grasping by a second hand of the operator while the operator is also grasping the first handle in the operator's first hand;

an electric drive motor assembly disposed at least partially within the body, the electric drive motor assembly including at least an electric drive motor;

an output shaft extending from the central portion of the body within an arc between the first handle and the second handle, the output shaft being operatively coupled to the electric drive motor to produce linear reciprocating motion at a distal end of the output shaft, said linear reciprocating motion defining a reciprocation axis;

a rotation mechanism that enables the output shaft to rotate relative to the first handle and the second handle; and an extension handle that releasably engages the first handle, the extension handle being suitable for a user to hold the percussive massage appliance by the extension handle while using the percussive massage appliance to deliver a percussive massage to himself;

wherein the first axis and the second axis intersect at a point within the rotation mechanism.

22. The percussive electric massage appliance of claim 21 wherein:

a longitudinal axis of the extension handle defines an extension handle longitudinal axis; and the rotation mechanism enables the output shaft to rotate relative to the first handle and the second handle portions to a position in which the reciprocation axis forms an angle of less than 70° with the extension handle longitudinal axis.

23. The percussive electric massage appliance of claim 21, wherein:

the rotation mechanism enables the output shaft to rotate so that, in a first position, the reciprocation axis extends within the first handle; and the rotation mechanism further enables the output shaft to rotate so that, in a second position, the reciprocation axis extends within the second handle.

24. The percussive electric massage appliance of claim 23, wherein:

in the first position, the reciprocation axis extends parallel to the first axis; and in the second position, the reciprocation axis extends parallel to the second axis.

* * * * *